US008561553B2

(12) United States Patent
Morse et al.

(10) Patent No.: US 8,561,553 B2
(45) Date of Patent: Oct. 22, 2013

(54) SOLID FUEL NOZZLE TIP ASSEMBLY

(75) Inventors: Gregory L. Morse, Auburn, MA (US); Ivo Slezak, Hubbardston, MA (US); Paulo Cavalcanti, Shrewsbury, MA (US)

(73) Assignee: Babcock Power Services, Inc., Worcester, MA (US)

( * ) Notice: Subject to any disclaimer, the term of this patent is extended or adjusted under 35 U.S.C. 154(b) by 899 days.

(21) Appl. No.: 12/640,404

(22) Filed: Dec. 17, 2009

(65) Prior Publication Data

US 2011/0146545 A1 Jun. 23, 2011

(51) Int. Cl.
*F23D 1/00* (2006.01)
*F23K 3/02* (2006.01)

(52) U.S. Cl.
USPC ..... 110/104 B; 110/261; 110/265

(58) Field of Classification Search
USPC ..... 110/260, 261, 263, 264, 265, 347, 104 B
See application file for complete search history.

(56) References Cited

U.S. PATENT DOCUMENTS

| | | | | | |
|---|---|---|---|---|---|
| 2,895,435 | A | * | 7/1959 | Bogot et al. | 239/587.4 |
| 3,823,875 | A | * | 7/1974 | Bauer et al. | 239/419.5 |
| 4,274,343 | A | | 6/1981 | Kokkinos | |
| 4,356,975 | A | * | 11/1982 | Chadshay | 239/419.5 |
| 4,520,739 | A | * | 6/1985 | McCartney et al. | 110/263 |
| 4,581,041 | A | | 4/1986 | Covell et al. | |
| 4,891,935 | A | | 1/1990 | McLaurin et al. | |
| 5,215,259 | A | * | 6/1993 | Wark | 239/587.6 |
| 5,392,720 | A | * | 2/1995 | Briggs et al. | 110/264 |
| 5,435,492 | A | * | 7/1995 | Tenerowicz | 239/587.6 |
| 5,623,884 | A | | 4/1997 | Penterson et al. | |
| 6,003,793 | A | * | 12/1999 | Mann | 239/587.5 |
| 6,089,171 | A | * | 7/2000 | Fong et al. | 110/263 |
| 6,145,449 | A | * | 11/2000 | Kaneko et al. | 110/261 |
| 6,189,812 | B1 | | 2/2001 | Buridant | |
| 6,260,491 | B1 | * | 7/2001 | Grusha | 110/261 |
| 6,367,394 | B1 | * | 4/2002 | Kaneko et al. | 110/263 |
| 6,439,136 | B1 | * | 8/2002 | Mann et al. | 110/263 |
| 6,959,653 | B1 | * | 11/2005 | Mann et al. | 110/263 |

(Continued)

FOREIGN PATENT DOCUMENTS

EP 1184621 A1 3/2002

OTHER PUBLICATIONS

International Search Report and Written Opinion dated Aug. 22, 2011 for Application No. PCT/US2010/060171.

(Continued)

*Primary Examiner* — Kenneth Rinehart
*Assistant Examiner* — David J Laux
(74) *Attorney, Agent, or Firm* — Edwards Wildman Palmer LLP; Joshua L. Jones

(57) ABSTRACT

A solid fuel nozzle tip for issuing a flow of mixed solid fuel and air into a boiler or furnace includes an outer nozzle body having an outer flow channel extending therethrough from an inlet to an outlet of the outer nozzle body. An inner nozzle body has an inner flow channel extending therethrough from an inlet to an outlet of the inner nozzle body. The inner nozzle body is mounted within the outer nozzle body with the inner flow channel inboard of and substantially aligned with the outer flow channel. The inner and outer nozzle bodies are joined together so as to accommodate movement relative to one another due to thermal expansion and contraction of the outer and inner nozzle bodies.

18 Claims, 6 Drawing Sheets

(56) References Cited

U.S. PATENT DOCUMENTS

| | | | | |
|---|---|---|---|---|
| 8,267,020 | B2 * | 9/2012 | Mann | 110/104 B |
| 2009/0277364 | A1 | 11/2009 | Donais et al. | |
| 2011/0117507 | A1 * | 5/2011 | Briggs et al. | 431/189 |

OTHER PUBLICATIONS

European Search Report dated May 16, 2013 for European Application EP 10 84 2493.

* cited by examiner

Fig. 1
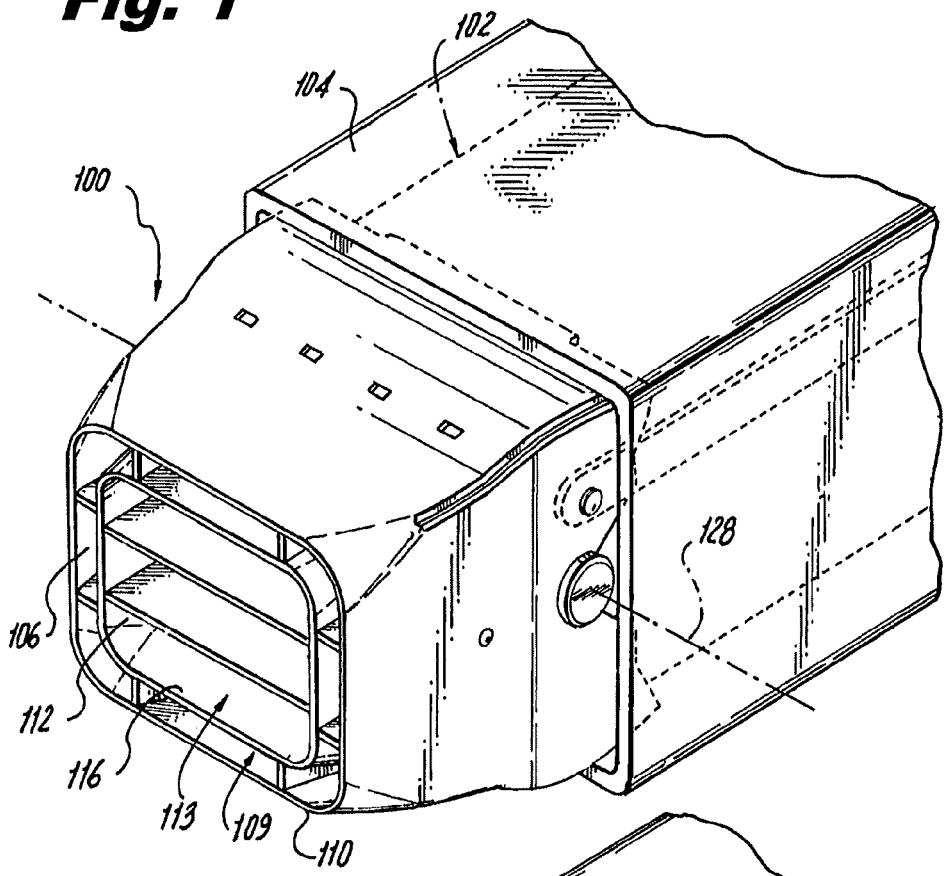
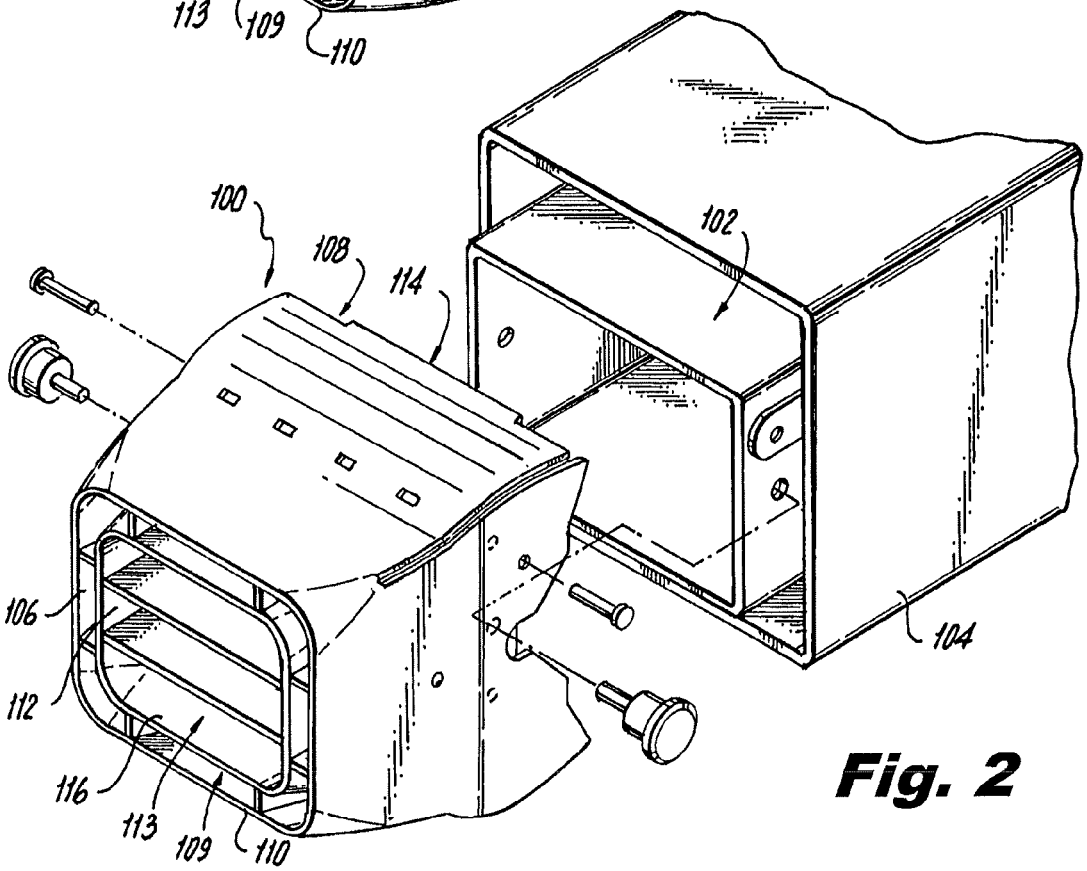
Fig. 2

SOLID FUEL NOZZLE TIP ASSEMBLY

BACKGROUND OF THE INVENTION

1. Field of the Invention

The present invention relates to solid fuel delivery systems, and more particularly to solid fuel nozzle tips for issuing solid fuel into boilers.

2. Description of Related Art

A variety of systems and devices are known for delivering solid fuel for combustion in a boiler. Many such devices are directed to nozzles for delivering solid coal particles to coal fired boilers or furnaces, for example. Coal powered plants require an efficient means of supplying coal as fuel to produce heat power. Raw coal is typically pulverized in a coal pulverizer or mill to produce small coal particles or coal dust. The pulverized coal must then be delivered to a furnace or burner where it can be used for combustion. This is typically done with a coal piping system that utilizes air flows to transport pulverized coal particles from the mill or pulverizer to a nozzle where coal particles are injected into the coal burner or furnace.

A great deal of effort has been made to design coal tip nozzles capable of providing controlled, evenly distributed streams of coal and air. Non-uniform particle distribution causes various technical problems for operation and maintenance of coal systems. If poor particle distribution extends into the combustion zone, localized imbalances in the fuel/air mixture can cause inefficient combustion and elevated emissions of $NO_x$, CO, and other pollutants. It can also cause elevated levels of unburned carbon in the fly ash, which will lower combustion efficiency.

In order to improve flow and velocity distribution, known coal tip nozzles have incorporated flow vanes, splitter plates, multiple shrouds, and the like to provide desirable flow characteristics. Typical coal tip nozzles are constructed with the shrouds, vanes, and splitter plates all welded together into a single solid piece. However, the heating on typical coal tip nozzles is uneven. Uneven heating results from temperature gradients across the nozzle tip, ranging from the high temperature at the outlet, which is exposed to flame temperature within the boiler or furnace, to the relatively cool flow of air and coal particles entering the nozzle tip at the inlet. All of the components experience different amounts of heating and there is typically an appreciable difference experienced by the inner and outer shrouds of typical designs. The differential thermal expansion in typical designs results in internal stresses which can lead to failure and limited service life.

One attempt to address the thermal expansion gradients in typical coal tip nozzles has been to recess vanes or support means mounted between inner and outer shrouds back from the outlet. Such a configuration is shown in U.S. Pat. No. 6,089,171 to Fong et al. This approach, however, is still relatively restrictive to thermal expansion and contraction of inner and outer nozzle components. In addition, the recessed vanes have reduced ability to channel flow through the nozzle.

Such conventional methods and systems have generally been considered satisfactory for their intended purpose. However, there is still a need in the art for solid fuel tip nozzles that allow for improved accommodation of thermal expansion. There also remains a need in the art for such devices that are easy to make and use. The present invention provides a solution for these problems.

SUMMARY OF THE INVENTION

The subject invention is directed to a new and useful solid fuel nozzle tip for issuing a flow of mixed solid fuel and air into a boiler or furnace. The solid fuel nozzle tip includes an outer nozzle body having an outer flow channel extending therethrough from an inlet to an outlet of the outer nozzle body. An inner nozzle body has an inner flow channel extending therethrough from an inlet to an outlet of the inner nozzle body. The inner nozzle body is mounted within the outer nozzle body with the inner flow channel inboard of and substantially aligned with the outer flow channel. The inner and outer nozzle bodies are joined together so as to accommodate movement relative to one another due to thermal expansion and contraction of the outer and inner nozzle bodies.

In accordance with certain embodiments, the inner and outer nozzle bodies are joined together by at least one pin with at least one of the inner and outer nozzle bodies being free to move along the at least one pin to accommodate movement of the inner and outer nozzle bodies relative to one another due to thermal expansion and contraction. The at least one pin can be welded to the outer nozzle body. At least one pin can pass through the inner and outer nozzle bodies from an area exterior to the outer nozzle body into the inner flow channel of the inner nozzle body. There can be three such pins mounting the inner and outer nozzle bodies together, or any other suitable number.

In certain embodiments, a plurality of flow guide vanes is mounted within the outer flow channel between the inner and outer nozzle bodies to direct flow through the outer flow channel. The flow guide vanes can extend substantially from the inlet to the outlet of the outer nozzle body. The flow guide vanes can be mounted for movement relative to the inner nozzle body and to be stationary with respect to the outer nozzle body, or vice versa. It is also contemplated that the inner and outer nozzle bodies can be joined together so as to accommodate common rotation thereof about a common rotational axis to direct flow through the inner and outer flow channels along a selectable angle.

In accordance with certain embodiments, the outer nozzle body is substantially four-sided and the inner nozzle body is also substantially four-sided. The inner nozzle body is mounted within the outer nozzle body with the inner flow channel inboard of and substantially concentric and aligned with the outer flow channel. A first nozzle body support is mounted within the outer flow channel between a first side of the outer nozzle body and a first side of the inner nozzle body. A second nozzle body support is mounted within the outer flow channel between a second side of the outer nozzle body and a second side of the inner nozzle body. A third nozzle body support is mounted within the outer flow channel between a third side of the outer nozzle body and a third side of the inner nozzle body. Each of the three nozzle body supports has a mounting pin passing therethrough joining the outer and inner nozzle bodies together to accommodate relative thermal expansion and contraction of the outer and inner nozzle bodies. Each of the flow guide vanes and nozzle body supports can be welded to the outer nozzle body.

The invention also provides a method of constructing a solid fuel nozzle tip for issuing a flow of mixed solid fuel and air to a boiler. The method includes welding a plurality of flow vanes to an outer nozzle body having an outer flow channel extending therethrough from an inlet to an outlet of the outer nozzle body. The method also includes positioning an inner nozzle body inside the outer flow channel of the outer nozzle body, wherein the inner nozzle body has an inner flow channel extending therethrough from an inlet to an outlet of the inner nozzle body. The step of positioning includes substantially aligning the inner and outer flow channels. The method also includes mounting the inner and outer nozzle bodies together using at least one mounting pin configured to accommodate relative thermal expansion and contraction of the outer and inner nozzle bodies. The step of mounting can include welding the at least one mounting pin to the outer nozzle body.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 1 is a perspective view of an exemplary embodiment of a solid fuel nozzle tip constructed in accordance with the present invention, showing the nozzle tip connected to the nozzle;

FIG. 2 is an exploded perspective view of the solid fuel nozzle tip of FIG. 1, showing the nozzle tip separated from the nozzle;

DETAILED DESCRIPTION OF THE PREFERRED EMBODIMENTS

Figure 3:
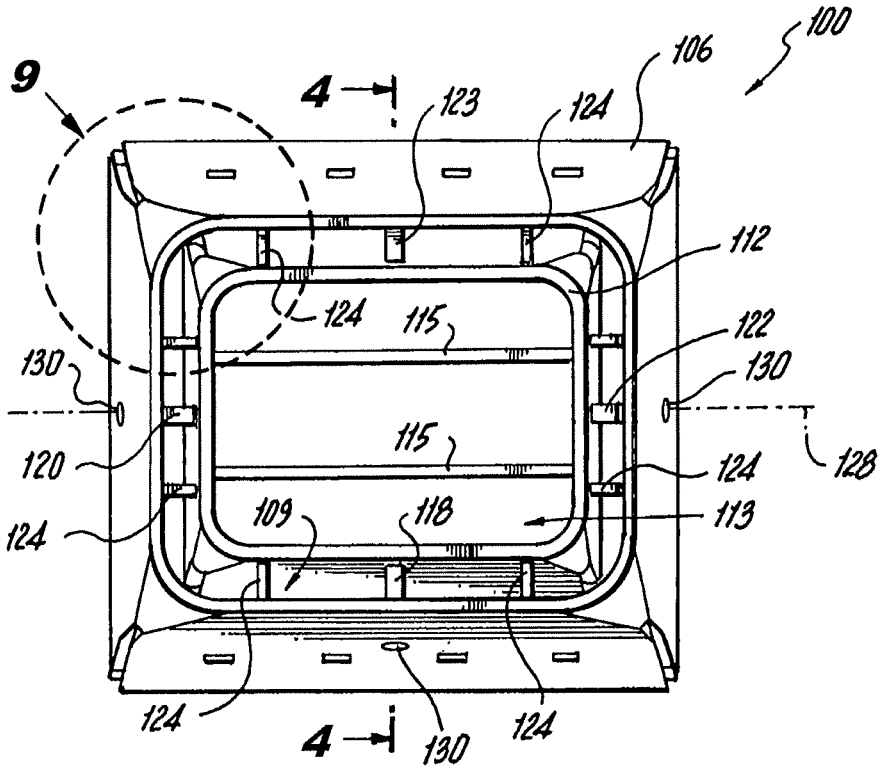
FIG. 3 is a front elevation view of the solid fuel nozzle tip of FIG. 1, showing the inner and outer nozzle bodies.

Reference will now be made to the drawings wherein like reference numerals identify similar structural features or aspects of the subject invention. For purposes of explanation and illustration, and not limitation, a partial view of an exemplary embodiment of a solid fuel nozzle tip in accordance with the invention is shown in FIG. 1 and is designated generally by reference character 100. Other embodiments of solid fuel nozzle tips in accordance with the invention, or aspects thereof, are provided in FIGS. 2-12, as will be described. The systems of the invention can be used to increase service life in solid fuel nozzle tips.

In FIG. 1, solid fuel nozzle tip 100 is shown connected to a nozzle 102 for issuing a flow of mixed solid fuel and air into a boiler or furnace. The solid fuel can be, for example, air borne coal particles, and the boiler or furnace can be coal fired. Nozzle tip 100 is the terminal portion of nozzle 102, and is thus the last portion of a piping system through which solid fuel passes en route to the combustion space of the respective furnace or boiler. Nozzle tip 100 is therefore provided with features that allow for channeling and controlling a jet of solid fuel entering the combustion space to allow for combustion control.

Referring to FIGS. 1 and 2, nozzle tip 100 includes an outer nozzle body 106 having an outer flow channel 109 extending therethrough from an inlet 108 to an outlet 110 of outer nozzle body 106. An inner nozzle body 112 has an inner flow channel 113 extending therethrough from an inlet 114 to an outlet 116 of inner nozzle body 112. Inner and outer nozzle bodies 112 and 106 may also be referred to as inner and outer nozzle tip shells Inner nozzle body 112 is mounted within outer nozzle body 106 with inner flow channel 113 inboard of and substantially aligned with outer flow channel 109. Inner and outer nozzle bodies 112 and 106 are joined together so as to accommodate movement relative to one another due to thermal expansion and contraction, as will be described in greater detail below.

Referring now to FIG. 2, nozzle tip 100 is connected to nozzle 102 with a flow path passing through nozzle 102 into inner flow channel 113 of nozzle tip 100, as indicated. A shroud 104 defines a second flow path that includes outer flow channel 109 of nozzle tip 100. Flow through outer and inner flow channels 109 and 113 can be independently controlled as needed to control combustion. In an exemplary application, fuel such as pulverized air borne coal can be issued through inner flow channel 113 and combustion air can be issued through outer flow channel 109.

Referring now to FIG. 3, outer and inner nozzle bodies 106 and 112 are substantially four-sided, as are the respective outer and inner flow channels 109 and 113. Inner nozzle body 112 is mounted within outer nozzle body 106 with inner flow channel 113 inboard of and substantially concentric and aligned with outer flow channel 109. A first nozzle body support 118 is mounted within outer flow channel 109 between a first side of outer nozzle body 106 and a first side of inner nozzle body 112, which is on the bottom as oriented in FIG. 3. Second and third nozzle body supports 120 and 122 are also mounted within outer flow channel 109 on the left and right sides of outer nozzle body 106, as oriented in FIG. 3. Each of the three nozzle body supports 118, 120, and 122 has a mounting pin 130 passing therethrough joining outer and inner nozzle bodies 106 and 112 together, as will be described in greater detail below. Support 123 at the top of outer flow channel 109, as oriented in FIG. 3, is similar in configuration to supports 118, 120, and 122, except support 123 does not include a mounting pin passing therethrough. Supports 118, 120, 122, and 123 are advantageously welded only to outer nozzle body 106, as will be described in further detail below. A mounting pin is not necessary for support 123 at the top of outer flow channel 109 because the three pins 130 are sufficient to provide translational and rotational support constraints for all axes.

Figure 4:
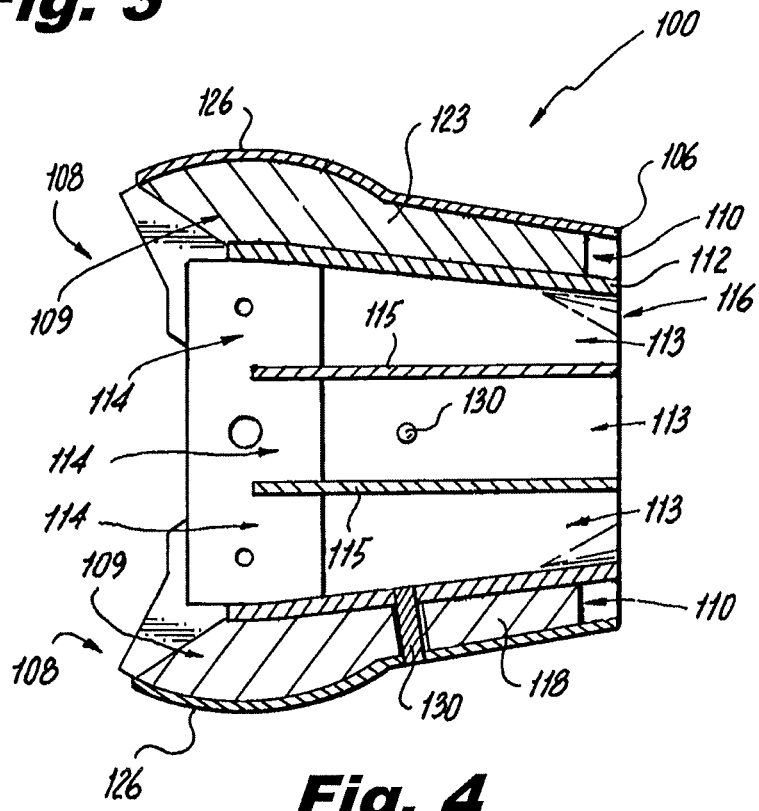
FIG. 4 is a cross-sectional side elevation view of the solid fuel nozzle tip of FIG. 1, showing the cross-section taken at section 4-4 of FIG. 3.

With continued reference to FIG. 3, multiple flow guide vanes 124 are mounted within outer flow channel 109 between the inner and outer nozzle bodies 112 and 106 to direct flow through outer flow channel 109. Vanes 124 and supports 118, 120, 122, and 123 extend substantially from inlet 108 to outlet 110 of outer nozzle body 106, as shown in FIG. 4. Supports 118, 120, 122, and 123 are configured to function as vanes in conjunction with vanes 124 in outer flow channel 109. Inner flow channel 113 includes two flow divider plates 115 to provide flow control therethrough. Supports 118, 120, and 122 are each split into two separate plates to accommodate the respective mounting pins 130, as shown for example in FIG. 4 where the two separate plates of the inlet and outlet portions of support 118 are shown with a gap therebetween accommodating a pin 130.

Referring now to FIG. 4, outer nozzle body 106 includes opposed cylindrical portions 126, which accommodate rotational movement of nozzle tip 100 relative to stationary nozzle 102 about axis 128, which is indicated in FIGS. 1 and 3. Outer and inner nozzle bodies 106 and 112 are joined together for common rotation about rotational axis 128 to direct flow through inner and outer flow channels 113 and 109 along a selectable angle.

Figure 5:
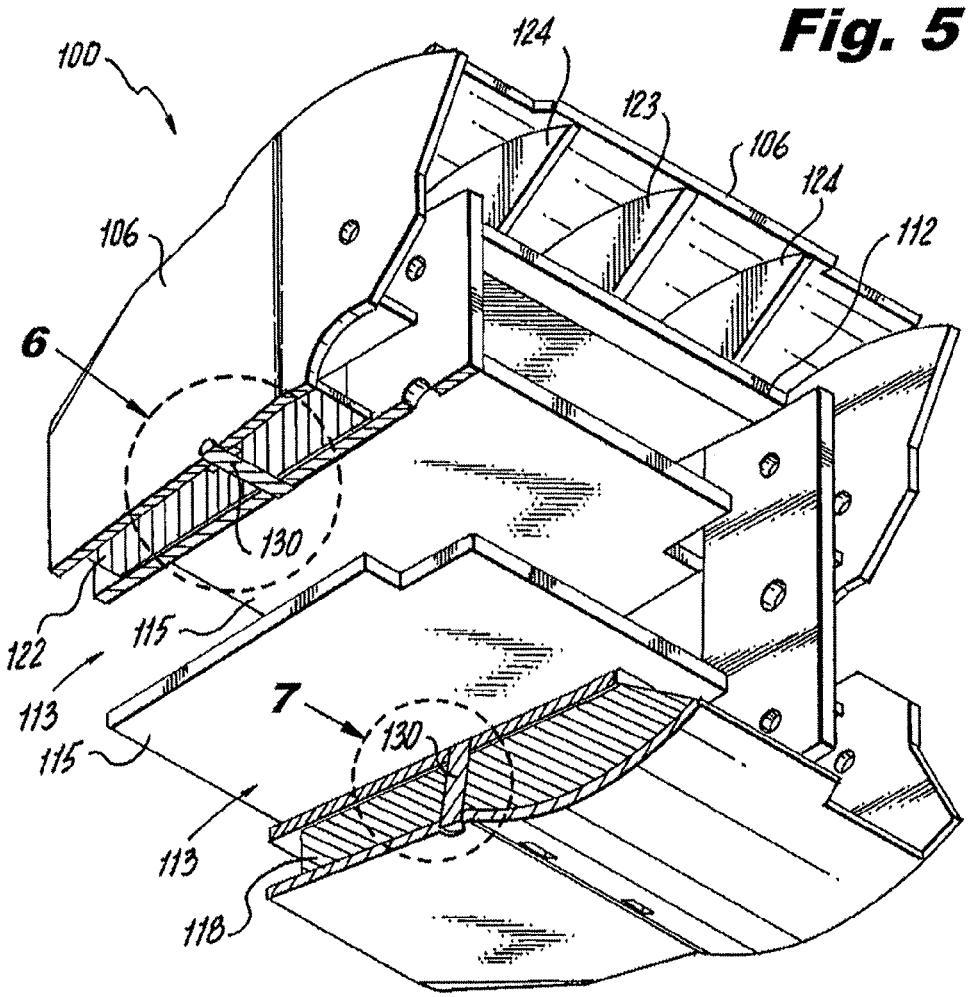
FIG. 5 is partial cross-sectional perspective view of the solid fuel nozzle tip of FIG. 1, showing two of the mounting pins joining the inner and outer nozzle bodies.
Figure 6:
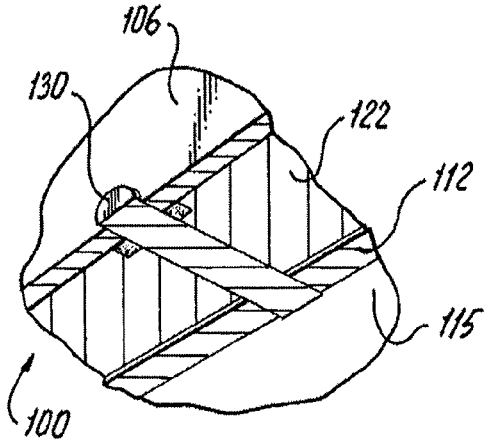
FIG. 6 is a cross-sectional perspective view of a portion of the solid fuel nozzle tip of FIG. 1, showing an enlarged detail of one of the mounting pins as indicated by arrow 6 in FIG. 5.
Figure 7:
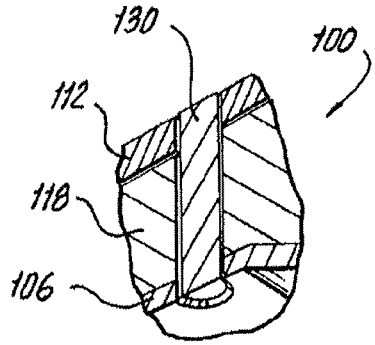
FIG. 7 is a cross-sectional perspective view of a portion of the solid fuel nozzle tip of FIG. 1, showing an enlarged detail of one of the mounting pins as indicated by arrow 7 in FIG. 5.

Referring now to FIGS. 5-7, inner and outer nozzle bodies 112 and 106 are joined together with pins 130. Each pin 130 is welded to outer nozzle body 106. Pins 130 can pass through the inner and outer nozzle bodies 112 and 106 from an area exterior to outer nozzle body 106 into inner flow channel 113, as shown in FIG. 6. It is also possible for pins 130 to be recessed from one or more nozzle body surfaces, as shown in FIG. 7. Pins 130 on the lateral sides, as shown in FIGS. 5 and 6, protrude into a recess formed in flow divider plate 115. The three pins 130 extend from outer nozzle body 106 into inner nozzle body 112, and are only welded to outer nozzle body 106. This allows inner nozzle body 112 to float on the three pins 130 to permit differential expansion and contraction between inner and outer nozzle bodies 112 and 106 with reduced stresses. The holes in inner nozzle body 112 accommodating the three pins 130 are toleranced for a sliding fit. While shown and described herein in the exemplary context of using three pins 130 welded to outer nozzle body 106, those skilled in the art will readily appreciate that any other suitable number of pins can be used, and that any of the pins can instead be welded to inner nozzle body 106, without departing from the spirit and scope of the invention.

Mounting inner and outer nozzle bodies 112 and 106 together in this manner makes inner and outer nozzle bodies 112 and 106 relatively stationary with respect to one another to maintain fixed integral support and alignment. However, this manner of attachment also leaves inner and outer nozzle bodies 112 and 106 free for movement relative to one another to accommodate thermal expansion and contraction. This mounting arrangement reduces attachment stresses in high temperature areas to reduce distortion in nozzle plating to provide longer service life compared to previously known nozzle tips. It also provides the advantage of making manufacturing more economical and allowing easier access for welding and assembly.

Figure 8:
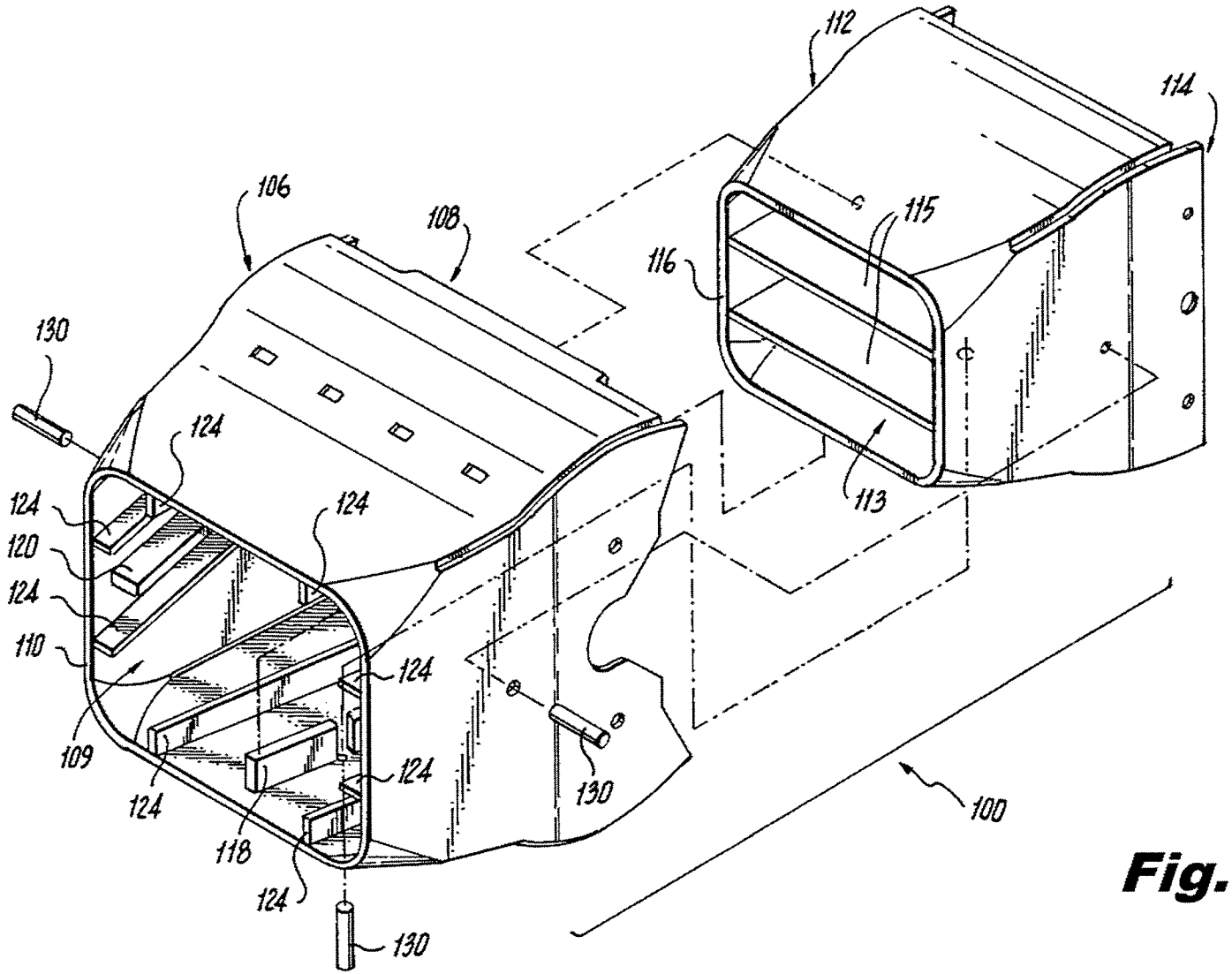
FIG. 8 is an exploded perspective view of the solid fuel nozzle tip of FIG. 1, showing the inner nozzle body separated from the outer nozzle body.

Referring now to FIG. 8, the construction of nozzle tip 100 will now be described. As indicated in FIG. 8, flow vanes 124 and supports 118, 120, 122, and 123 are welded in place to outer nozzle body 106, within inner flow channel 109 thereof. Inner nozzle body 112 can then be positioned inside outer flow channel 109 of outer nozzle body 106, to align inner and outer flow channels 113 and 109. With inner and outer nozzle bodies 112 and 106 positioned and aligned, they can be mounted together using mounting pins 130, as described above. The step of mounting the inner and outer nozzle bodies 112 and 106 together can be done at room temperature, for example, since thermal expansion and contraction are accommodated as described above. Each of the inner and outer nozzle bodies 112 and 106 is a single, solid welded construction, however when mounted together by pins 130, relative movement of inner and outer nozzle bodies 112 and 106 is accommodated, as described above. Vanes 124 are mounted for movement relative to inner nozzle body 112 and to be relatively stationary with respect to outer nozzle body 106. It is also possible to weld vanes 124 and supports 118, 120, 122, and 123 to inner nozzle body 112 and leave them free for movement relative to outer nozzle body 106. Moreover, those skilled in the art will readily appreciate that some or all of the vanes can be welded to either nozzle body in any suitable configuration without departing from the spirit and scope of the invention. Those skilled in the arts will readily appreciate that any suitable number of vanes 124 or divider plates 115 can be used, and that any other suitable joining method besides welding can be used without departing from the spirit and scope of the invention.

Figure 9:
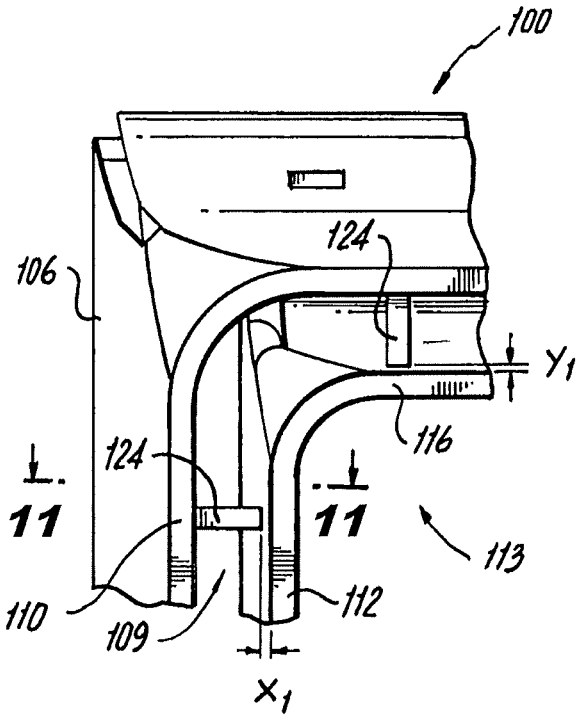
FIG. 9 is a front elevation view of a portion of the solid fuel nozzle tip of FIG. 1, showing an enlarged detail taken at arrow 9 in FIG. 3 with the inner and outer nozzle bodies relaxed, e.g., in the absence of thermal expansion or contraction.
Figure 10:
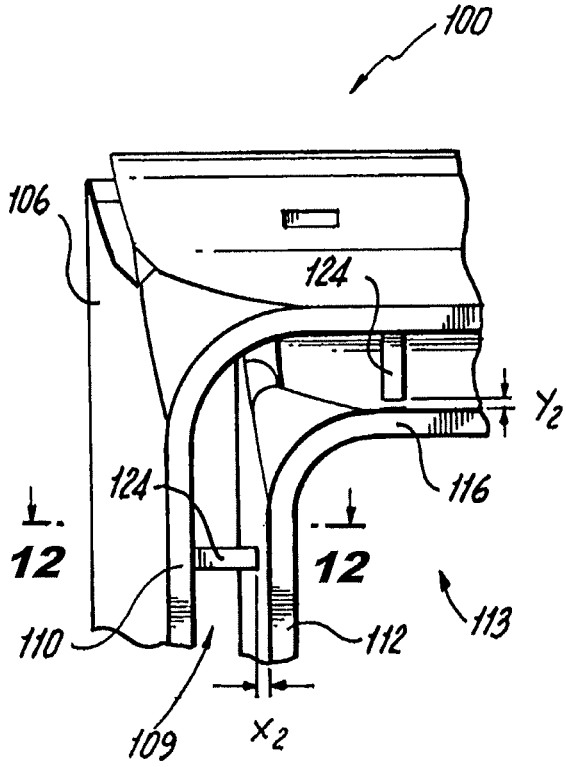
FIG. 10 is a front elevation view of a portion of the solid fuel nozzle tip of FIG. 1, showing an enlarged detail taken at arrow 9 in FIG. 3 with the inner and outer nozzle bodies undergoing thermal expansion.

Referring now to FIGS. 9-12, the thermal expansion of outer and inner nozzle bodies 106 and 112 will be discussed in greater detail. FIG. 9 shows a close up of the upper left corner of nozzle tip 100, as oriented in FIG. 3. The outlets 116 and 110 of inner and outer nozzle bodies 112 and 106 are shown in the relaxed condition, with no thermal expansion or contraction. In FIG. 10, the same portions of nozzle tip 100 are shown as in FIG. 9. However, in FIG. 10, the outlets 116 and 110 of inner and outer nozzle bodies 112 and 106 are shown in the thermally expanded state as when nozzle tip 100 is installed in an operating boiler or furnace. Thermal expansion in FIG. 10 is exaggerated for clarity.

As can be seen by comparing FIGS. 9 and 10, outer flow channel 109 is widened in the thermally expanded state due to the fact that outer nozzle body 106 expands more than inner nozzle body 112. This is due to the fact that outer nozzle body 106 reaches higher temperatures because it is more exposed to the radiant energy and high temperatures of combustion than is inner nozzle body 112 and because it contains a higher temperature flow of air, for example in a typical coal fired application. In the room temperature or cold condition, a gap, labeled $X_1$ in FIG. 9 is provided between vanes 124 and outlet 116 of inner nozzle body 112. A similar gap, labeled $Y_1$ is formed in the vertical direction, as oriented in FIG. 9. These gaps, $X_1$ and $Y_1$, are provided in the room temperature or cold condition to allow for fabrication tolerancing and to help ensure the inner and outer nozzle bodies 112 and 106 do not make hard contact, increasing service life. A suitable cold condition gap sizes are about 1/16 inches, however any suitable gap size can be used for a given application. Under thermal expansion, gaps $X_1$ and $Y_1$ are expanded as indicated in FIG. 10 to gaps $X_2$ and $Y_2$, respectively. The gap $X_2$ is larger than gap $X_1$ and the gap $Y_2$ is larger than gap $Y_1$ due to thermal expansion. The increased gaps $X_2$ and $Y_2$ represents movement of outer nozzle body 106 relative to inner nozzle body 112 in the horizontal and vertical directions, as oriented in FIG. 10.

Figure 11:
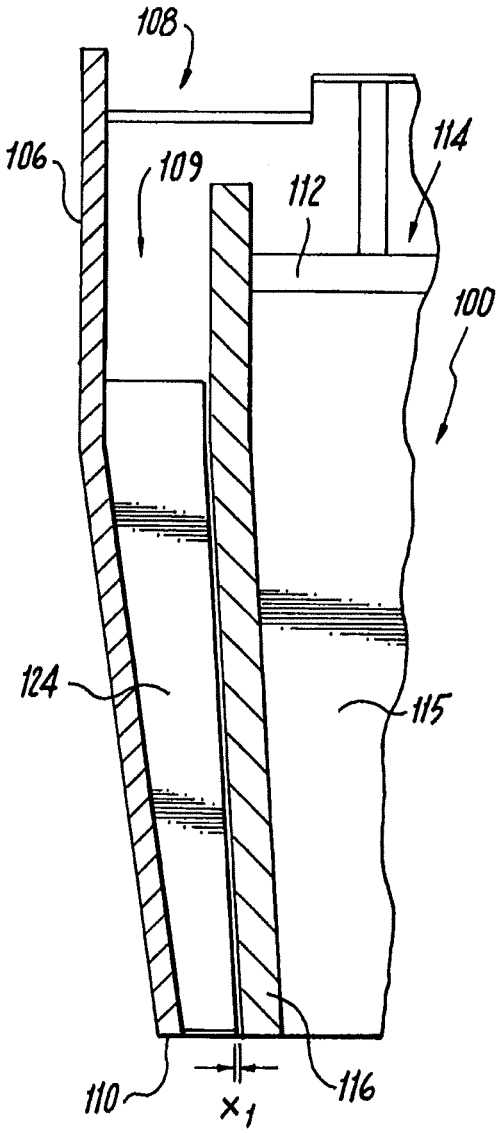
FIG. 11 is a cross-sectional plan view of a portion of the solid fuel nozzle tip of FIG. 1, showing the inner and outer nozzle bodies relaxed, e.g., in the absence of thermal expansion or contraction.
Figure 12:
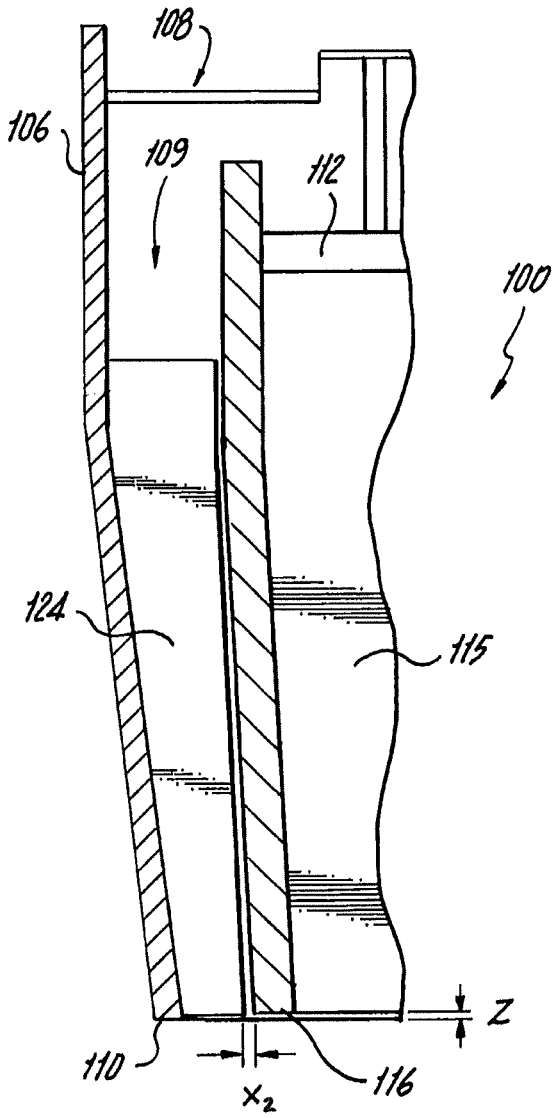
FIG. 12 is a cross-sectional plan view of a portion of the solid fuel nozzle tip of FIG. 1, showing the inner and outer nozzle bodies undergoing thermal expansion.

Referring now to FIGS. 11 and 12, the same phenomenon is shown from a plan view. FIG. 11 shows how outlets 116 and 110 of inner and outer nozzle bodies 112 and 106 are aligned in the relaxed condition, without any thermal expansion or contraction. FIG. 12 shows the same view as FIG. 11, but with outlets 116 and 110 of inner and outer nozzle bodies 112 and 106 shown in the thermally expanded state as when nozzle tip 100 is under operating conditions. As can be seen by comparing FIGS. 11 and 12, outlet 110 of outer nozzle body 106 expands further in the downstream direction than does outlet 116 of inner nozzle body 112. The different downstream thermal expansion between inner and outer nozzle bodies 112 and 106 is indicated by gap Z in FIG. 12. Again, this is due to the fact that outer nozzle body 106 is more exposed to the radiant heat energy and high temperatures of combustion than is inner nozzle body 112.

An exemplary application utilizes inner coal/air flow through inner flow channel 113 at around 130-160° F. and an outer combustion air flow through outer flow channel 109 at around 550-700° F. For a typically sized nozzle tip 100 made of 309 stainless steal, RA253MA, or other suitable materials, thermal expansion differentials can be as much as around 1/16 inches.

Since inner and outer nozzle bodies 112 and 106 are mounted together by pins 130, rather than being welded along the lengths of fins 124 and supports 118, 120, 122, and 123, for example, greater accommodation is made for relative thermal expansion between inner and outer nozzle bodies 112 and 106. This greater accommodation of relative thermal expansion leads to longer service life compared to conventional solid fuel nozzle tips.

The methods and systems of the present invention, as described above and shown in the drawings, provide for improved service life for solid fuel nozzle tips with superior properties including allowing inner and outer nozzle bodies to thermally expand and contract independently and freely while maintaining fixed integral support and alignment. The methods and systems described above also provide for greater ease of assembly. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A solid fuel nozzle tip for issuing a flow of mixed solid fuel and air to a boiler comprising:

a) an outer nozzle body having an outer flow channel extending therethrough from an inlet to an outlet of the outer nozzle body; and b) an inner nozzle body having an inner flow channel extending therethrough from an inlet to an outlet of the inner nozzle body, the inner nozzle body being mounted within the outer nozzle body with the inner flow channel inboard of and substantially aligned with the outer flow channel, wherein the inner and outer nozzle bodies are joined together so as to accommodate movement relative to one another due to thermal expansion and contraction of the outer and inner nozzle bodies, wherein the inner and outer nozzle bodies are joined together by three pins to constrain the inner and outer nozzle bodies against relative rotation, but allow relative translation along the pins to accommodate movement of the inner and outer nozzle bodies relative to one another due to thermal expansion and contraction.

2. A solid fuel nozzle tip as recited in claim 1, wherein at least one of the pins is welded to the outer nozzle body.

3. A solid fuel nozzle tip as recited in claim 1, wherein at least one of the pins passes through the inner and outer nozzle bodies from an area exterior to the outer nozzle body into the inner flow channel of the inner nozzle body.

4. A solid fuel nozzle tip as recited in claim 1, further comprising a plurality of flow guide vanes mounted within the outer flow channel between the inner and outer nozzle bodies to direct flow through the outer flow channel.

5. A solid fuel nozzle tip as recited in claim 4, wherein the flow guide vanes extend substantially from the inlet to the outlet of the outer nozzle body.

6. A solid fuel nozzle tip as recited in claim 4, wherein the flow guide vanes are mounted for movement relative to the inner nozzle body and to be stationary with respect to the outer nozzle body.

7. A solid fuel nozzle tip as recited in claim 4, wherein the flow guide vanes are mounted for movement relative to the outer nozzle body and to be stationary with respect to the inner nozzle body.

8. A solid fuel nozzle tip as recited in claim 1, wherein the inner and outer nozzle bodies are joined together so as to accommodate common rotation thereof about a common rotational axis to direct flow through the inner and outer flow channels along a selectable angle.

9. A solid fuel nozzle tip for issuing a flow of mixed solid fuel and air to a boiler comprising:

a) a substantially four-sided outer nozzle body having an outer flow channel extending therethrough from an inlet to an outlet of the outer nozzle body;

b) a substantially four-sided inner nozzle body defining an inner flow channel extending therethrough from an inlet to an outlet of the inner nozzle body, the inner nozzle body being mounted within the outer nozzle body with the inner flow channel inboard of and substantially concentric and aligned with the outer flow channel;

c) a first nozzle body support mounted within the outer flow channel between a first side of the outer nozzle body and a first side of the inner nozzle body;

d) a second nozzle body support mounted within the outer flow channel between a second side of the outer nozzle body and a second side of the inner nozzle body; and e) a third nozzle body support mounted within the outer flow channel between a third side of the outer nozzle body and a third side of the inner nozzle body, wherein, each of the three nozzle body supports has a mounting pin passing therethrough joining the outer and inner nozzle bodies together to constrain the inner and outer nozzle bodies against relative rotation, but accommodate relative thermal expansion and contraction of the outer and inner nozzle bodies.

10. A solid fuel nozzle tip as recited in claim 9, wherein each mounting pin is welded to the outer nozzle body.

11. A solid fuel nozzle tip as recited in claim 9, wherein each mounting pin passes through the inner and outer nozzle bodies from an area exterior to the outer nozzle body into the inner flow channel of the inner nozzle body.

12. A solid fuel nozzle tip as recited in claim 9, further comprising a plurality of flow guide vanes mounted within the outer flow channel between the inner and outer nozzle bodies to direct flow through the outer flow channel.

13. A solid fuel nozzle tip as recited in claim 12, wherein the flow guide vanes extend substantially from the inlet to the outlet of the outer nozzle body.

14. A solid fuel nozzle tip as recited in claim 12, wherein the flow guide vanes are mounted for movement relative to the inner nozzle body and to be stationary with respect to the outer nozzle body.

15. A solid fuel nozzle tip as recited in claim 14, wherein each of the flow guide vanes and nozzle body supports are welded to the outer nozzle body.

16. A solid fuel nozzle tip as recited in claim 9, wherein the inner and outer nozzle bodies are configured and adapted for common rotation thereof about a common rotational axis to direct flow through the inner and outer flow channels along a selectable angle.

17. A method of constructing a solid fuel nozzle tip for issuing a flow of mixed solid fuel and air to a boiler comprising:

a) welding a plurality of flow vanes to an outer nozzle body having an outer flow channel extending therethrough from an inlet to an outlet of the outer nozzle body;

b) positioning an inner nozzle body inside the outer flow channel of the outer nozzle body, wherein the inner nozzle body has an inner flow channel extending therethrough from an inlet to an outlet of the inner nozzle body, wherein the step of positioning includes substantially aligning the inner and outer flow channels; and c) mounting the inner and outer nozzle bodies together using three pins to constrain the inner and outer nozzle bodies against relative rotation, but allow relative translation along the pins to accommodate movement of the inner and outer nozzle bodies relative to one another due to thermal expansion and contraction.

18. A method of constructing a solid fuel nozzle tip as recited in claim 17, wherein the step of mounting includes welding at least one of the mounting pins to the outer nozzle body.

* * * * *